US005941417A

United States Patent [19]

Andersson et al.

[11] Patent Number: 5,941,417

[45] Date of Patent: Aug. 24, 1999

[54] FILL SYSTEM EQUIPPED WITH APPARATUS FOR CONTINUOUS CONTROLLED INFLOW TO A BALANCE TANK

[75] Inventors: Bengt Andersson, Palatine, Ill.; Rickard Franke, Dalby, Sweden; Per Brandstrom, Hunnebostrand, Sweden; Johan Hegardt, Lund, Sweden

[73] Assignee: Tetra Laval Holdings & Finance, SA, Pully, Switzerland

[21] Appl. No.: 08/864,557

[22] Filed: May 28, 1997

[51] Int. Cl.[6] ..... B65B 3/00

[52] U.S. Cl. ..... 222/64; 222/67; 137/391; 137/409

[58] Field of Search ..... 137/391, 409; 222/64, 67

[56] References Cited

U.S. PATENT DOCUMENTS

| | | | |
|---|---|---|---|
| 3,443,692 | 5/1969 | Halsey | 137/391 |
| 3,509,695 | 5/1970 | Egan et al. | 137/409 |
| 3,599,666 | 8/1971 | Curtis et al. | 137/391 |
| 3,653,543 | 4/1972 | Preikschat | 222/64 |
| 4,428,505 | 1/1984 | Casey et al. | 222/64 |
| 4,458,827 | 7/1984 | Stelte | 222/64 |
| 4,561,566 | 12/1985 | Slobodnik | 222/67 |
| 4,852,053 | 7/1989 | Turrie | 137/391 |
| 5,592,979 | 1/1997 | Payne et al. | 141/59 |
| 5,680,960 | 10/1997 | Keyes et al. | 222/64 |

*Primary Examiner*—J. Casimer Jacyna

[57] ABSTRACT

A system to be utilized at a dairy in the distribution of a pumpable food product from a storage tank to a filling machine for dispensing into containers. The system includes a balance tank for storing the product on the filling machine. The balance tank is in flow communication with a storage tank via a product line, and also has a level probe for monitoring the amount of product in the tank. A product pump pumps the food product to a valve mechanism which is also disposed on the product line. A programmable logic controller receives a signal from the probe indicative of the level of the product in the balance tank, and generates a series of signals to the product pump and the valve mechanism to maintain a steady flow of product from the storage tank to the balance tank. In this manner, foaming of the product in the balance tank is eliminated or substantially reduced to acceptable levels.

3 Claims, 1 Drawing Sheet

FILL SYSTEM EQUIPPED WITH APPARATUS FOR CONTINUOUS CONTROLLED INFLOW TO A BALANCE TANK

BACKGROUND OF THE INVENTION

The present invention relates to a method and apparatus for accurately controlling the inflow to and outflow from a balance tank or other intermediate storage tank of a filling machine. More particularly, the present invention relates to a method and apparatus for monitoring and controlling the inflow of a particular fluid into a balance tank of a filling machine to provide a more consistent flow of fluid from the balance tank for use in filling packages.

During the filling process of packages in the filling machine, a certain amount of product fluid is pumped out of a balance tank at various intervals to fill packages with a set amount of that fluid. In order to keep the supply of product fluid in the balance tank at a sufficient level for the continuous filling of packages, a holding tank at a dairy facility or the like is connected to the balance tank by a product line allowing fluid to be pumped to the balance tank. Accurately controlling the inflow of fluid into the balance tank of a filling machine has been the subject of various development efforts. Additionally, providing a quick and effective method for cleaning the balance tank and other apparatus for an efficient change over to a different fluid has also been the subject of development efforts.

Various methods and apparatus have been used to control and monitor the inflow rate of fluid into a balance tank in an effort to achieve equal inflow and outflow rates. For example, it is known to use a float valve at the inlet to the balance tank which is mechanically connected to a flow control valve. When the level of fluid in the tank drops below a predetermined level, the float valve opens to allow more fluid to flow in from the dairy through the product line. When sufficient fluid is in the tank, such as when the filling process is complete, the inflow of fluid raises the up to or beyond the predetermined level and the valve mechanically closes, thus preventing any additional flow of fluid into the tank from the dairy.

However, as these prior systems attempted to keep the inflow into the tank equaling the outflow from the tank, the valve was constantly open and the fluid was flowing in at a constant rate. The rate of the fluid flowing into these prior tanks could not be controlled and tended to cause foaming of the fluid in the balance tank. The foaming of the fluid is similar to how orange juice foams when it is shaken too hard. This foam in the balance tank would ultimately be pumped out of the tank and into the packages thereby causing inaccuracies in the filling process of the packages. An additional disadvantage of this prior method and apparatus was that it had to be manually cleaned.

Another prior method involved electrically connecting a valve located at the inlet to the balance tank to a two sensor probe. The probe operated by sensing a maximum fill level and a minimum fill level. When the first sensor detected that the fluid level in the tank was at the minimum level, the valve would be automatically opened to allow fluid to flow in and fill the tank. When the second sensor detected that the tank had been filled to the maximum level, the valve would be automatically closed preventing further egress of fluid into the tank. This valve system of this prior method did not provide uniform flow into the balance tank. In the position where the valve was fully open, it would allow the fluid to flow in at such a rate as to cause foaming of the fluid in the balance tank and thus inaccurate filling of the packages, as discussed above.

Additionally, the use of a two-step valve was known in the art. In one position, the valve provided for a low inflow rate of fluid into the balance tank. In the other position, the valve would be fully opened allowing for a much larger inflow rate of fluid into the balance tank. None of these prior art systems provided for a fully automatic filling system with feedback control that provided the requisite filling accuracy. Additionally, none of these systems provided for the capability of automatic cleaning of the system.

BRIEF SUMMARY OF THE INVENTION

A method and apparatus for accurately filling packages in a filling machine is disclosed. The disclosed filling machine overcomes the aforementioned problems of filling inaccuracies by providing a method and apparatus for continuously controlling the rate of inflow of filling fluid into the filling machine. The disclosed filling machine includes a balance tank for storing a product fluid. The balance tank includes an inlet and an outlet. The inlet is in fluid communication with a source of product fluid and the outlet is in fluid communication with a filling system of the product packaging machine that dispenses the product fluid into the container. A valve mechanism is disposed to the control flow of the product fluid to the inlet of the balance tank. The valve mechanism has an opening through which the product fluid flows to the inlet of the balance tank. The opening of the valve mechanism is responsive to an input signal for controlling the size thereof in a generally continuous manner whereby a plurality of different sized openings may be used. A level probe is positioned in the balance tank for providing an output signal indicative of the level of the product fluid in said balance tank. A controller responsive to the output signal of the level probe is used to provide the input signal to the valve mechanism in response to the sensed level of product fluid thereby allowing the controller to control the flow of the product fluid through the inlet into the balance tank so that the flow of the product fluid into the balance tank is approximately equal to the flow of the product fluid through said outlet of the balance tank.

In accordance with a further embodiment of the product packaging machine that is particularly suitable for use with pressure-sensitive liquids, the speed of a product pump is controlled by a controller or the like to control the rate at which the product fluid is provided to the inlet of the balance tank. The speed of the product pump is controlled dependent on the output signal of the level sensor.

The disclosed method and apparatus is suitable for use with both standard dairy products such as milk and pressure sensitive products such as yogurt that are sensitive to pressure increases that can occur at the product valve. An operator panel is preferably included for selection of either a standard fluid or a pressure sensitive fluid. The operator panel can be located either locally at the filling machine or at a location remote of the filling machine.

The disclosed method and apparatus is advantageous over prior art methods and apparatus because it minimizes the risk of foaming and product degradation because the flow rate of the product fluid is controlled in a generally continuous manner. The disclosed method and apparatus also has the advantage of being compatible with various types of filling fluids. Additionally, because the disclosed method and apparatus are fully automatic it can be readily used in automatic cleaning operations.

Additional features and advantages of the present invention will become apparent to one of skilled in the art upon consideration of the following.

BRIEF DESCRIPTION OF THE SEVERAL VIEWS OF THE DRAWINGS

A preferred embodiment of the present invention is described by reference to the following drawing.

DETAILED DESCRIPTION OF THE INVENTION

Figure 1:
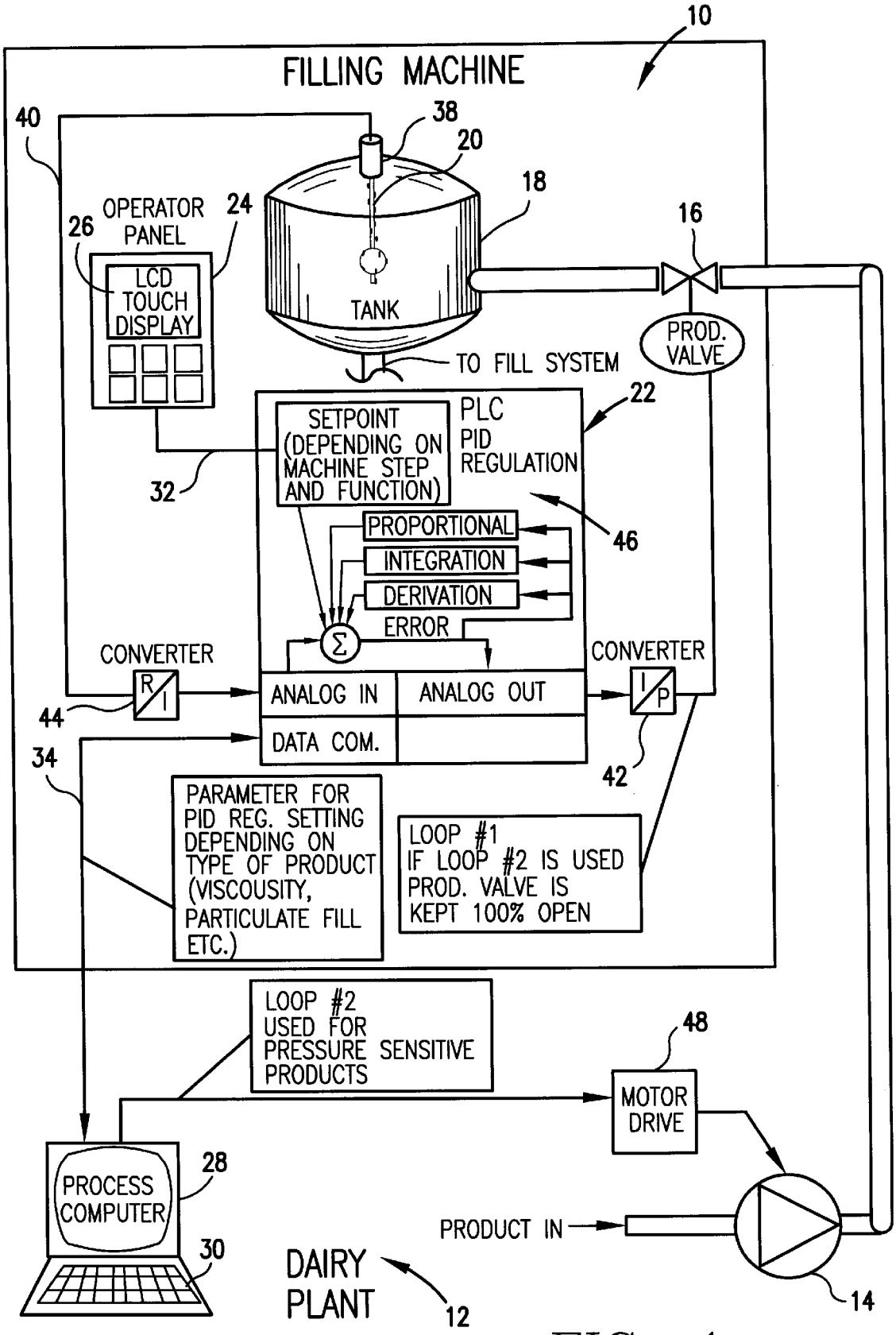
FIG. 1 is a schematic drawing of a filling machine in accordance with a preferred embodiment of the present invention.

Referring to FIG. 1, a filling machine 10 is schematically illustrated. The filling machine 10 includes a dairy plant generally indicated by reference number 12, a product pump 14, a product valve 16, a balance tank 18, a level probe 20 located within the balance tank 18, and a PLC 22. An operator panel 24 is associated with the filling machine 10 allowing an operator to select the type of product to be filled. The operator panel 24 preferably includes a selection switch 26 allowing for the selection of various types of filling products. The selection switch is preferably an area or icon on an LCD touch display which when touched communicates the type of product to be filled to the PLC 22. Alternatively, the selection switch can be any commercially available switch. A process computer 28 is also preferably included at the dairy plant to allow a customer to select the type of product to be transferred from the dairy plant to the filling machine 10 by entering the selection on the computer keyboard 30.

The preferred filling machine 10 is designed to accommodate two main types of filling products. In one embodiment, the filling machine 10 fills packages with standard products such as milk or juice. In another embodiment, the filling machine 10 fills packages with pressure sensitive products such as yogurt or the like. The pressure sensitive products are preferably handled in the filling process differently than the standard products because, if subjected to extreme pressures, the pressure sensitive product tends to degrade.

In one embodiment shown in FIG. 1, the filling system 10 is configured for filling packages with a standard filling product. Once a standard product has been selected for filling by the entry of such information into the operator panel 24 or the process computer 28, the filling product selection is transmitted to the PLC 22 via electrical path 32 or 34, respectively. The PLC 22 then sends an analog signal to the process computer at the dairy via electrical path 34 to initiate the transfer of filling fluid from the dairy to the balance tank 18. At the beginning of the filling process, the filling fluid is transferred from the dairy via the product pump 14 through a product line 36 to the balance tank 18 at, for example, a rate of approximately 1 liter/sec. The rate of the product pump 14 is preferably controlled by the PLC 22 and this slow fill up rate improves the accuracy of the filling process by preventing initial foaming of the fluid in the balance tank 18. Initially, the product valve 16 is fully open to allow the inflow of fluid into the tank 18. As shown in FIG. 1, the product valve 16 is located in the product line 36 at or near the inlet to the balance tank 18. Thereafter, the rate of filling fluid into the tank is controlled, as described below, such that the rate of fluid into the tank 18 equals the rate of fluid out of the tank 18. The preferred flow of fluid from the tank 18 is 6,000 liters/hr, but is dependent upon the filling rate at which the machine is operated.

The level probe 20 is affixed to the top 38 of the balance tank 18 and continuously monitors the level of fluid in the tank. This information regarding fluid level in the tank 18 is transferred to the PLC 22 via an electrical connection 40 for processing. When the level probe 20 sends a signal to the PLC 22 that the fluid level in the balance tank 18 is either too high or too low, the PLC 22, via a current/pressure (I/P) converter 42, changes the position of the product valve 16 to account for the low or high level of filling fluid in the tank 18. If too much fluid is in the balance tank 18, the product valve 16 is closed by a certain amount by the PLC 22 to restrict the inflow of fluid into the balance tank 18. Conversely, if there is not enough filling fluid in the balance tank 18 the product valve 16 will be opened further by the PLC 22 to increase the inflow of fluid. The preferred I/P converter 42 is any commercially available I/P converter with an accuracy of about 1%. Additionally, the converter 42 is preferably pneumatically powered.

During the filling process, a separate pump (not shown) pumps filling fluid out of the balance tank 18 for use in filling packages. Depending upon the rate at which the fluid flows out of the balance tank 18, the level probe 20 will cause the PLC 22 to change the opening of the product valve 16, via the pneumatic I/P converter 42, to increase or decrease the amount of fluid flowing into the balance tank 18. To further enhance the accuracy of the filling process, the analog signal in line 40 from the probe 20 is amplified by an R/I converter 44 prior to being delivered to the PLC 22.

In the preferred embodiment, the PLC 22 is any commercially available PLC with a standard proportional integrated derivative (PID) loop added thereto. The PID loop, generally indicated by reference number 46, functions to control the output of fluid from the balance tank 18 and also maintain a relatively constant level of fluid in the balance tank 18. PID loops are known in the art and operate based on certain parameters that are dictated by the type of product selected, its viscosity and other factors. Based on these parameters and a standard PID template, one of skill in the art could readily program the PID to operate within the parameters disclosed herein. The probe 20 is preferably a Kübler probe and the amplifier 44 is also preferably a Kübler converter.

In another embodiment shown in FIG. 1, the filling machine 10 is configured for filling packages with a pressure sensitive product. Once a pressure sensitive product has been selected for filling by the entry of such information into the operator panel 24 or the process computer 28, the filling product selection is transmitted to the PLC 22 via electrical connection 32 or 34, respectively. When the PLC 32 receives a signal from operator panel 24 that a pressure sensitive product has been selected for filling, it sends an analog signal to the process computer 28 via electrical path 34. The process computer 28 is preferably located at the diary plant but may also be located at any other convenient location. The process computer 28 then signals a motor drive 46 to drive the product pump 14 at the proper rate to pump filling product from the dairy. The filling product from the holding tank at the dairy (not shown) is initially pumped, at a predetermined rate, through the product pipe 36, through the product valve 16, to the balance tank 18. In the preferred embodiment, the product pump 14 is a positive pressure pump so that when pressure sensitive fluids are transferred to the balance tank 18 for use in the filling process they will not be subjected to excessive pressure and damaged. The product pump can be any commercially available positive pressure pump, including, a diaphragm pump or a screw pump.

In this embodiment, unlike when a standard product is being used to fill packages, the product valve 16 preferably remains fully open at all times. Again, this is to prevent the pressure sensitive product from being damaged from excessive pressure. The flow of the pressure sensitive fluid is controlled by regulating the speed of the motor drive 48 that drives the product pump 14 via the process computer 28 instead of by changing the position of the product valve 16. The product valve 16 can be any commercially available valve. Alternatively, the valve can be modified such that it is cone shaped and alleviates any squeezing of the product.

In this latter embodiment, the product valve 16 preferably remains fully open allowing the pressure sensitive product to be pumped via product pump 14 through the product pipe 36, directly into the balance tank 18. The level probe 20 in the balance tank 18 monitors the level of the filling product in the tank 18 and continuously transmits the indication of the product level to the PLC 22. The PLC 22, through the PID loop 46, then determines at what speed the motor drive 48 should drive the product pump 14.

Depending upon what type of fluid is being used to fill packages, the PLC 22 is either controlling an analog operated pneumatic valve 42 which controls the product valve 16, or fully opening the product valve 16 (closing only in emergency cases) and sending an analog signal via electrical path 34 to the dairy for controlling the speed of the product pump 14. In either embodiment, because the filling machine 10 is part of a purely electrical control loop, the filling machine 10 will operate with a much higher degree of accuracy than prior machines. Additionally, for hygiene purposes, filling machines are typically cleaned both on a daily basis and between runs. Again, because the filling machine 10 is part of a purely electrical control loop, the embodiments of the present invention provide the added advantage of an entirely automated cleaning system, as opposed to the prior mechanical cleaning processes.

While only one preferred embodiment of the invention has been described hereinabove, those of ordinary skill in the art will recognize that this embodiment may be modified and altered without departing from the central spirit and scope of the invention. Thus, the embodiment described hereinabove is to be considered in all respects as illustrative and not restrictive, the scope of the invention being indicated by the appended claims, rather than by the foregoing descriptions, and all changes which come within the meaning and range of equivalency of the claims are intended to be embraced herein.

We claim:

1. A product packaging system for transporting a pumpable food product from a storage tank to a filling machine for dispensing into a container, the product packaging system comprising:

a balance tank for storing a predetermined quantity of the pumpable food product on the filling machine, the balance tank having an inlet and an outlet, the inlet being in fluid communication with the storage tank, the outlet being in fluid communication with a filling system of the filling machine;

a valve mechanism disposed on the filling machine, the valve mechanism controlling the flow of the pumpable food product to the inlet of the balance tank, the valve mechanism having an opening though which the pumpable food product flows to the inlet of the balance tank, the opening of the valve mechanism being responsive to an input signal for controlling the size thereof;

a product pump disposed to pump the pumpable food product from the storage tank to the inlet of the balance tank through the valve mechanism, the product pump being responsive to an input signal to control the rate at which the pumpable food product is supplied to the balance tank;

a level probe positioned in the balance tank for providing an output signal indicative of the level of the pumpable food product in the balance tank;

a programmable logic controller accepting the output signal of the level sensor and generating an output signal indicative of the speed at which the product pump is to operate to provide the pumpable food product from the storage tank to the balance tank, the programmable logic controller further providing the output signal to the valve mechanism to control the opening thereof so that the flow of the pumpable food product into the balance tank is approximately equal to the flow of the pumpable food product through the outlet of the balance tank in order to reduce or eliminate foaming in the balance tank; and a computer in communication with the programmable logic controller to receive the output signal indicative of the speed at which the product pump is to operate from the programmable logic controller, the computer providing an output signal to the pump mechanism to control the speed of the product pump in response to the received output signal.

2. The product packaging system according to claim 1 wherein the pumpable food product is yogurt.

3. The product packaging system according to claim 1 wherein the pumpable food product is milk.

* * * * *